US005116100A

United States Patent [19]

Iversen

[11] Patent Number: 5,116,100

[45] Date of Patent: May 26, 1992

[54] PORTABLE OCCUPANT-ARISING ASSIST SEAT WITH TORSION SPRINGS

[76] Inventor: Howard L. Iversen, P.O. Box 101, Shandon, Calif. 93461

[21] Appl. No.: 603,318

[22] Filed: Oct. 25, 1990

[51] Int. Cl.[5] ..... A47C 1/00

[52] U.S. Cl. ..... 297/313; 297/422; 297/257; 297/DIG. 10

[58] Field of Search ..... 297/313, 337, 338, 382, 297/411, 422, 414, DIG. 10, 312, 441, 252, 253, 234, 452, 257

[56] References Cited

U.S. PATENT DOCUMENTS

| | | | |
|---|---|---|---|
| 2,233,864 | 3/1941 | Edson | 297/422 |
| 2,957,515 | 10/1960 | Gibson | 297/252 |
| 3,158,398 | 11/1964 | Stryker | 297/337 |
| 3,399,926 | 9/1968 | Hehn | 297/452 |
| 3,659,897 | 5/1972 | Wright | 297/337 |
| 4,688,851 | 8/1987 | Whiteford | 297/313 |
| 4,778,217 | 10/1988 | Lane | 297/335 |

FOREIGN PATENT DOCUMENTS

| | | | |
|---|---|---|---|
| 965600 | 6/1957 | Fed. Rep. of Germany | 297/313 |
| 2447739 | 4/1975 | Fed. Rep. of Germany | 297/355 |

*Primary Examiner*—Kenneth J. Dorner
*Assistant Examiner*—James M. Gardner
*Attorney, Agent, or Firm*—Daniel C. McKown

[57] ABSTRACT

An apparatus that is placed on a soft seat, such as an easy chair or sofa to help its user in being seated and in arising includes a rigid U-shaped lower frame that is spanned by a sheet of pliable material that is in contact with the seat, and further includes an upper U-shaped frame formed of tubing that is spanned by a rigid panel. The upper frame is resiliently and pivotably mounted to the lower frame by means of left and right torson springs, which apply an upward force to the rigid panel, partially offsetting the user's weight when the user is seated on the rigid panel. The apparatus is provided with left and right hand holds that permit the user to steady himself as he sits down or arises. The apparatus is stable in use and easily portable owing to its light-weight construction.

5 Claims, 2 Drawing Sheets

PORTABLE OCCUPANT-ARISING ASSIST SEAT WITH TORSION SPRINGS

BACKGROUND OF THE INVENTION

1. Field of the Invention

The present invention is an apparatus that is placed on a seat to help its user in being seated and in arising from a sitting position.

2. The Prior Art

Almost everyone has experienced some difficulty in arising from a very soft sofa or easy chair. The softness of these seats results in the user's hips being rather low, relative to his knees, and results in the user's back being tilted to the rear. To arise from such a position places a demand on the user's muscles and joints.

A number of inventors have devised apparatus for helping people arise from a sitting position. For example, in U.S. Pat. No. 4,688,851 issued Aug. 25, 1987 to Whiteford, there is described a device that has a rigid lower leaf and a rigid upper leaf that are joined along the front edge of a chair by a tubular spring having a C-shaped cross-section.

In U.S. Pat. No. 3,158,398 issued Nov. 24, 1964, Stryker shows the use of a helical torsion spring to connect an upwardly pivoting seat to an underlying frame that can be attached to a wheel chair.

In U.S. Pat. No. 3,659,897 issued May 2, 1972, Wright shows a cushioned seat that is hinged to a base member and that is urged away from the base member by a set of curved leaf springs.

Thus, certain aspects of the present invention are shown in the prior art because they are essential for any device of this type. However, beyond these essential features, the present invention includes certain highly advantageous features that permit it to be distinguished from the prior art devices.

SUMMARY OF THE INVENTION

It is an object of the present invention to provide a seat helper that is portable and light in weight.

It is a further objective to provide a seat helper that cannot harm the chair or sofa on which it is used, and that requires no modification to the chair or sofa.

Another object of the present invention is to provide a seat helper that is stable in use.

As will be seen below, the seat helper of the present invention includes a novel structure for the portion that rests against the chair or sofa, which construction is extremely lightweight, and deliberately incapable of harming the chair or sofa. The structure of that portion also helps to prevent the apparatus from skidding on the chair or sofa as the user sits down or arises. Finally, the seat helper of the present invention includes integral hand holds that have proven to be very helpful to a larger number of users.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
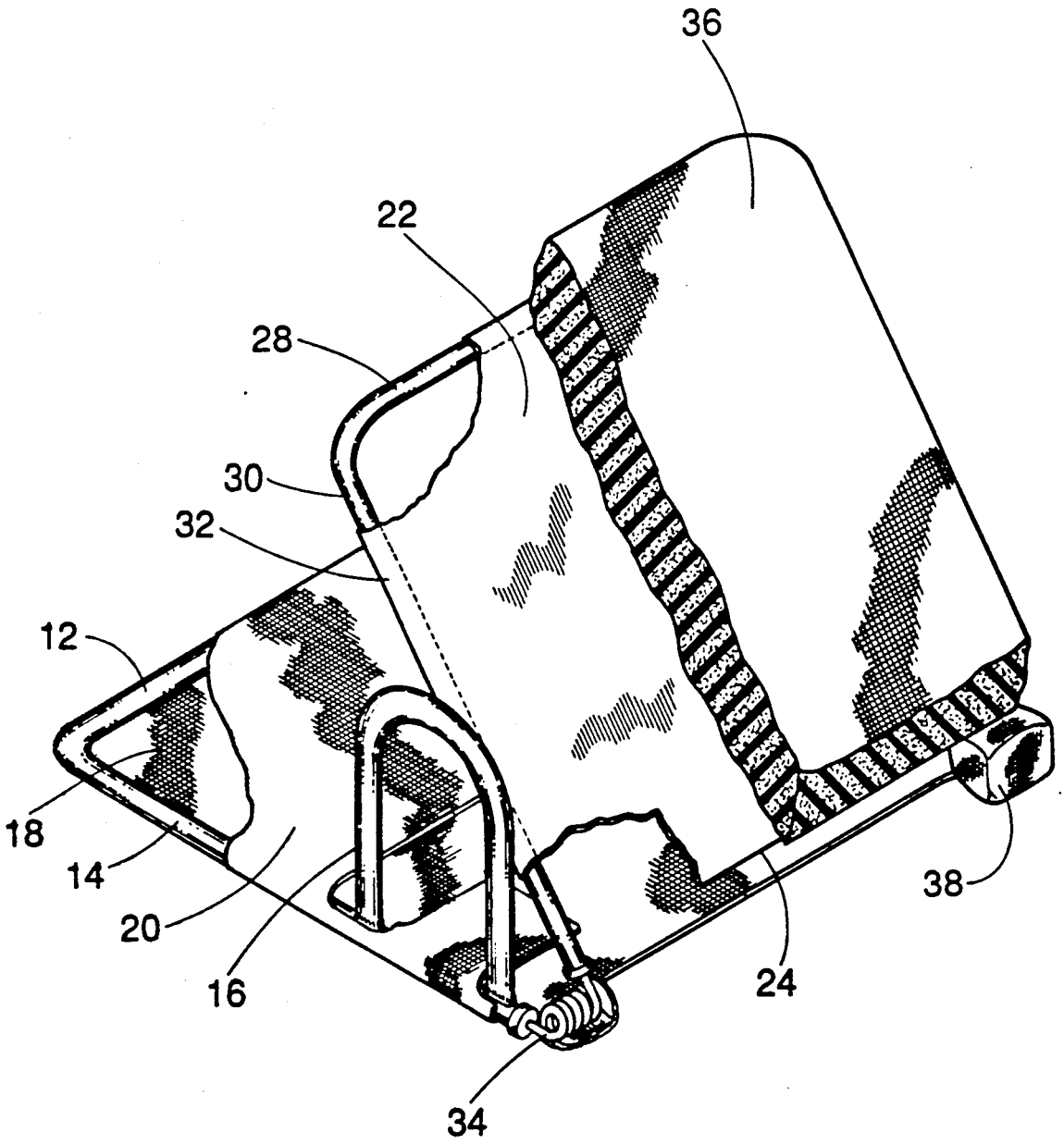
FIG. 1 is a perspective view showing the front, left side, and top of the seat helper of the present invention.
Figure 2:
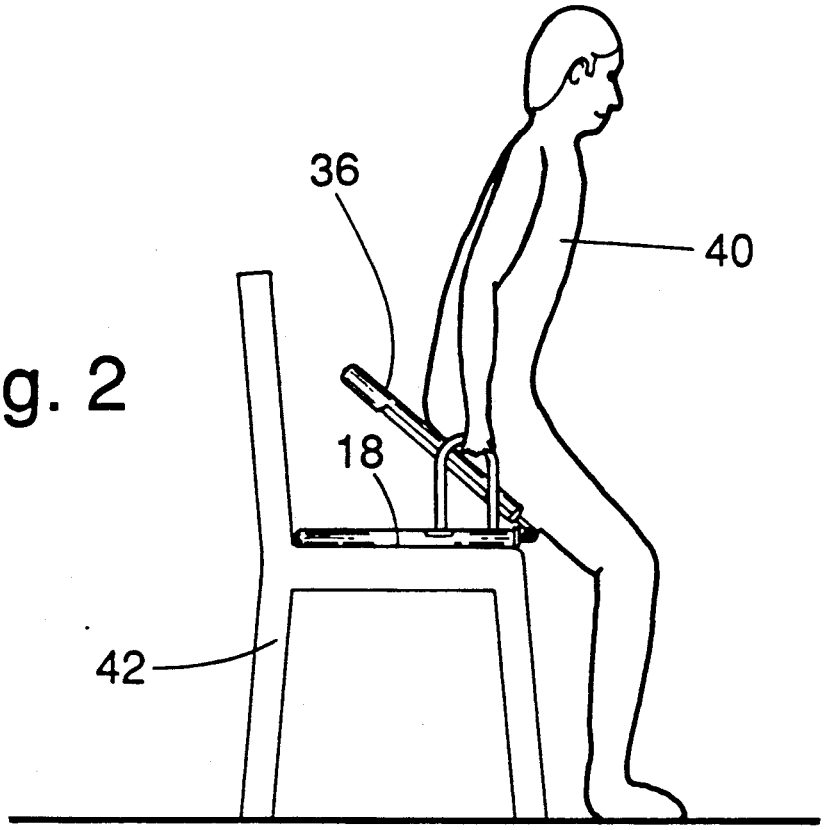
FIG. 2 is a side elevational view showing the seat helper of the present invention in use; and, FIG. 3 is a fractional perspective view showing the front left corner of the seat helper.
Figure 3:
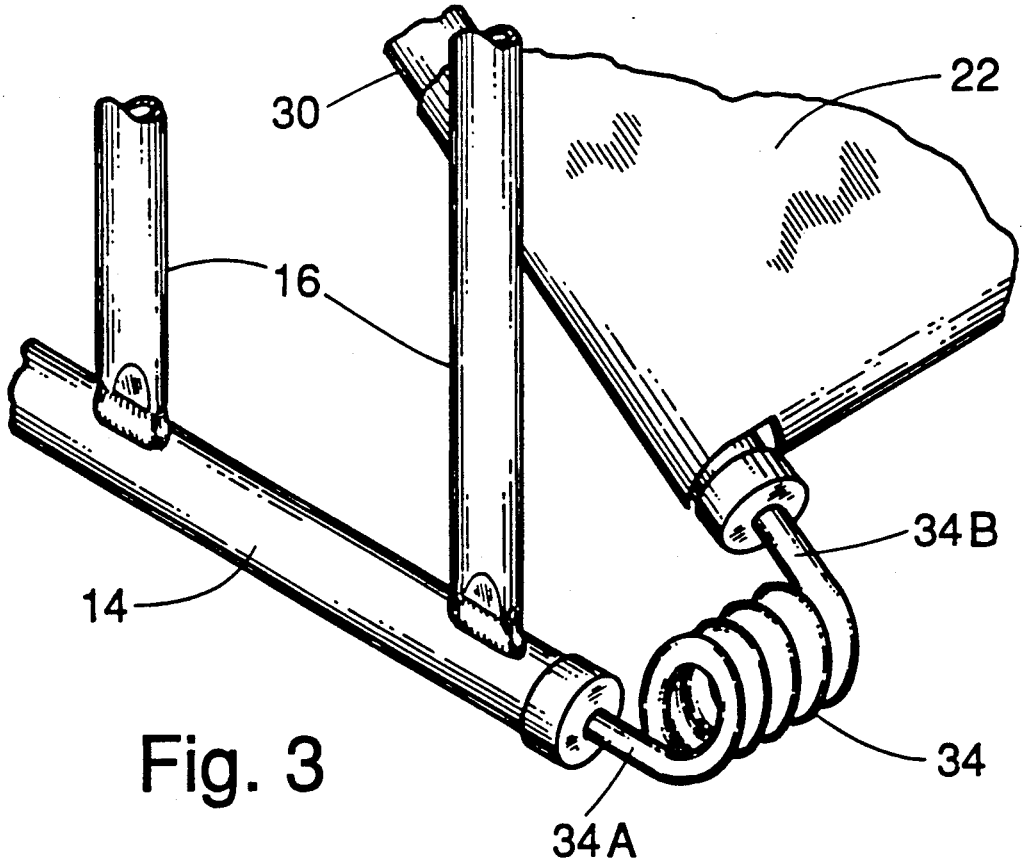

FIGS. 1-3 related to the same embodiment of the invention, which is the preferred embodiment. Like parts are denoted by the same reference numerals throughout.

It should be noted at the outset that the apparatus is symmetrical with respect to a vertical medial plane extending from the front to the rear of the apparatus.

The apparatus includes a lower rigid U-shaped frame that rests on the seat or sofa when the apparatus is in use. The frame is formed of a tubular material and includes a rear portion 12, a left side portion 14 and a right side portion. In the preferred embodiment the tubular material is steel tubing.

A left hand hold 16, formed of a tubular material in the preferred embodiment, is welded to the left side portion 14 of the U-shaped frame. A first sheet 18 of a pliable material spans the U-shaped frame. In the preferred embodiment the pliable material is a fabric. A second sheet 20 of pliable material is used, in the preferred embodiment, in combination with the first sheet 18 to form a pocket into which the U-shaped frame extends.

In use, the first sheet 18 of pliable material is in direct contact with the upper surface of the seat with which the apparatus is to be used. The sheet 18 tends to prevent the apparatus from sliding with respect to the seat, thereby eliminating a potential hazard for the infirm people who will be using the apparatus.

A second rigid U-shaped frame, also called the panel support, includes a rear portion 28, a left portion 30, and a right portion. This second U-shaped frame is also formed of a tubular material.

A stiff panel 22 spans the second U-shaped frame. The still panel 22 includes a front edge 24, a left edge and a right edge. In the preferred embodiment, the stiff panel is a molded sheet of plastic and it includes an edge portion 32 that wraps partly around the left portion 30 of the U-shaped panel support, and partly around the right portion of the panel support, as well as partly around the rear portion 28, so as to be retained on the U-shaped panel support.

It is noteworthy that neither the U-shaped frame that rests on the seat nor the U-shaped panel support includes a structural member that extends across the front of the apparatus. This is a design feature of the apparatus which permits the front portion of the apparatus to yield to the user's weight to conform to a more comfortable shape when in use. That is, the entire front portion of the apparatus is devoid of rigid horizontal structural members that would tend to impede the circulation of blood in the user's legs thereby causing discomfort. The front edge 24 of the stiff panel 22 is relatively thin, compared to the tubular members used throughout the apparatus, and not only presents less of an obstacle to the flow of blood, but also is flexible enough to deform to some extent to a more comfortable shape.

The upper U-shaped panel support is connected to the rigid U-shaped frame of the lower portion by a left torsion spring 34 and a right torsion spring, the latter located in a symmetrical position on the opposite side.

Each of the torsion springs have a frame shank 34A and a support shank 34B.

In the preferred embodiment, each of the torsion springs is enclosed in its own fabric pocket 38. In the preferred embodiment, a cushion 36 is provided, that overlays the stiff panel 22.

In FIG. 2 the user 40 has placed the apparatus on a chair 42 with the first sheet 18 of pliable material in contact with the upper surface of the seat of the chair. The user is gradually lowering his weight onto the cushion 36. Not how the user grasps the hand holds to steady himself and to obtain better control over his descent. Likewise, the user can use the hand holds to advantage to assist himself in arising from the chair.

FIG. 3 is a fractional perspective view showing in greater detail the front left corner of the seat helper.

In the preferred embodiment, the upper and lower frames are formed of metal tubing, and this results in a lightweight construction, rendering the apparatus easily portable.

As pointed out above, the use of a sheet 18 of pliable material serves to stabilize the apparatus on the chair or sofa with which it is used, and the hand holds further contribute to the security and stability of the apparatus.

Thus, there has been described a seat helper that is both stable in use, and easily portable due to its light weight.

The foregoing detailed description is illustrative of one embodiment of the invention, and it is to be understood that additional embodiments thereof will be obvious to those skilled in the art. The embodiment described herein together with those additional embodiments are considered to be within the scope of the invention.

What is claimed is:

1. Apparatus that is placed on a seat to help its user in being seated and in arising, said apparatus comprising:

a rigid tubular U-shaped frame that rests on the seat when in use and that includes a rear portion and right and left side portions, and that further includes right and left hand holds that extend upwardly from the right and left side portions respectively;

a sheet of a pliable material that spans said rigid tubular U-shaped frame and that supports and stabilizes the apparatus on the seat when in use;

a tubular U-shaped panel support having a left portion, a rear portion and a right portion, the width of said tubular U-shaped panel support being less than the spacing between the right and left hand holds;

right and left torsion springs resiliently connecting said rigid tubular U-shaped frame to said tubular U-shaped panel support and holding said tubular U-shaped panel support in an unloaded position in which it is inclined upwardly to the rear relative to said rigid tubular U-shaped frame, said right and left torsion springs permitting said tubular U-shaped panel support to yield to the user's weight by pivoting downward toward said rigid tubular U-shaped frame, said right and left torsion springs each including a frame shank extending into an end of said rigid tubular U-shaped frame, and each including a panel support shank extending into an end of said tubular U-shaped panel support.

2. The apparatus of claim 1 further comprising:

a panel of a stiff material that spans said tubular U-shaped panel support and is attached to it.

3. The apparatus of claim 2 wherein said panel of a stiff material wraps partly around the right and left side portions of said tubular U-shaped panel support.

4. The apparatus of claim 2 wherein said panel of a stiff material is composed of a plastic.

5. The apparatus of claim 1 wherein said left and right hand holds have an inverted U shape.

* * * * *